United States Patent [19]

Leuthold et al.

[11] Patent Number: 4,878,626

[45] **Date of Patent: * Nov. 7, 1989**

[54] APPARATUS FOR DESTROYING BANKNOTES

[75] Inventors: Karl Leuthold; Maul: Herbert, both of Munich; Walter Tröger, Martinsried; Alexander Serester, Munich, all of Fed. Rep. of Germany

[73] Assignee: GAO Gesellschaft fur Automation und Organisation mbH, Munich, Fed. Rep. of Germany

[ * ] Notice: The portion of the term of this patent subsequent to Jul. 5, 2005 has been disclaimed.

[21] Appl. No.: 181,549

[22] Filed: Apr. 14, 1988

Related U.S. Application Data

[60] Division of Ser. No. 49,012, May 12, 1987, Pat. No. 4,754,933, which is a continuation of Ser. No. 694,648, Jan. 24, 1985, abandoned.

[30] Foreign Application Priority Data

Dec. 7, 1984 [DE] Fed. Rep. of Germany ..... 3444709

[51] Int. Cl.[4] ..... B02C 4/08; B02C 23/26

[52] U.S. Cl. ..... 241/57; 241/60; 241/100; 241/236

[58] Field of Search ..... 241/100, 60, 236, 223, 241/166, 167, 57, 62

[56] References Cited

U.S. PATENT DOCUMENTS 3,396,914 8/1968 Liebman .
3,627,211 12/1971 Leach .
3,630,460 12/1971 Goldhammer .
3,860,180 1/1975 Goldhammer .
4,061,278 12/1977 Ehinger .
4,166,030 8/1979 Lewis et al. ..... 241/236 X
4,346,851 8/1982 Bernardi et al. .

FOREIGN PATENT DOCUMENTS 90248 10/1983 European Pat. Off. .
746592 12/1944 Fed. Rep. of Germany .
819616 11/1951 Fed. Rep. of Germany .
2524086 2/1976 Fed. Rep. of Germany .
2605226 8/1977 Fed. Rep. of Germany ..... 241/236
2759678 1/1979 Fed. Rep. of Germany .
2098503 11/1982 United Kingdom .

*Primary Examiner*—Mark Rosenbaum
*Attorney, Agent, or Firm*—Bacon & Thomas

[57] ABSTRACT

In a high-speed sorter, single documents such as banknotes are successively withdrawn from a stack and tested according to various criteria. Banknotes which are authentic but no longer fit for circulation are fed to a cutting means a shredder and destroyed therein. The shredder, which has a simple construction and is designed for a high banknote throughput, consists of two cutter blocks including overlapping cutter discs which work into one another with little play in spaced relationship and are provided along their periphery with notches, and which slit and crosscut the banknotes. A suction plant prevents back-ups from forming, cleans and cools the cutting means.

4 Claims, 3 Drawing Sheets

APPARATUS FOR DESTROYING BANKNOTES

Figure 1:
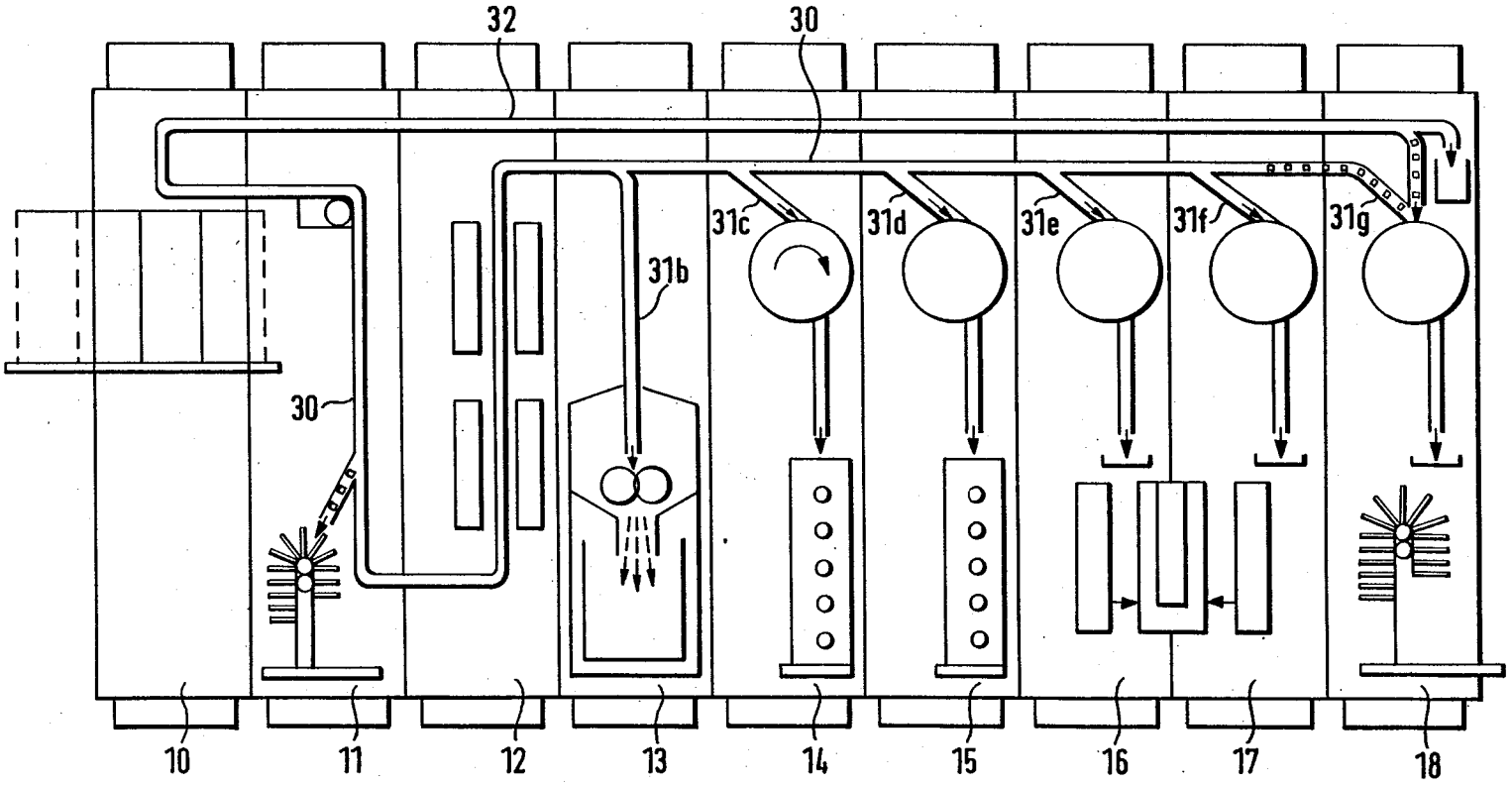

This application is division, of application Ser. no. 049,012, filed May 12, 1987, now U.S. Pat. No. 4,754,933, which is a continuation of application Ser. No. 695,648 filed Jan. 24, 1985, now abandoned.

The present invention relates to an apparatus for destroying documents such as banknotes in a high-speed banknote sorter, in which sorter the banknotes are removed from a stack one by one, tested according to various criteria and assigned to certain sorting classes as a result of the testing, one sorting class embracing banknotes which are authentic but no longer fit for circulation and which are supplied by a conveyor system to a cutting means and destroyed therein.

German Pat. No. 27 59 678 already discloses such an apparatus for destroying, after testing, banknotes which are no longer fit for circulation. The banknotes to be destroyed are supplied by a conveyor belt system directed across deflection rollers to a first cutting mechanism. This system comprising two cutter blocks which work into one another slits the banknotes into narrow strips. The strips are then fed via a funnel to a second cutting mechanism which is rotated by 90° relative to the first one. The cutter blocks of the second system rotate more slowly compared to the first system, thereby producing a controlled back-up of the banknote strips before the second cutting mechanism. Due to this back-up the banknote shreds are mixed up and come to lie crosswise so that they are additionally crosscut by the second cutting mechanism.

The known apparatus is advantageous in that the random jumbling and crosswise position of the banknote strips before the second cutting mechanism assures that the banknote shreds are always cut differently. The random nature of the shred shape is the more marked, the more the speeds of the two cutting mechanisms differ. Reconstruction of the cut up banknote shreds is therefore ruled out with almost absolute certainty.

To compensate the slower speed of the second cutting mechanism the cutter blocks of the second system have a larger diameter than those of the first system. In order to allow for processing of the back-up of banknotes before the second cutting mechanism, the back-up being necessary for jumbling them, it is also necessary to dimension the second cutting mechanism, or rather its required power, in such a way that its throughput capacity is higher than that of the first system. These dimensions must in practice be such that the greatest accumulation of banknotes to be expected can be processed, which means that it must also be possible in the extreme case for all the banknotes fed into the banknote sorter to be destroyed. Since such a large number of banknotes to be destroyed only comes about in exceptional cases, the second cutting mechanism is overdimensioned for normal operation.

Unlike the first cutting mechanism, the second cutting mechanism grasps the banknote strips strips irregularly, causing the cutting process to take place in an unpredictable manner. This provides the above-mentioned advantage of random cutting, but may lead, on the other hand, to disturbing side-effects. For example, it is possible that the strips pass through the second cutting mechanism in a longitudinal direction as well without being crosscut at all. On the other hand, there is also the possibility that very small banknote shreds are formed, or that the rotating cutting blades only slide along the banknotes, not immediately grasping them. The resulting rubbed-off scraps and/or the very small banknote shreds exit through the entry gap of the cutting apparatus, which is necessarily open, thereby contaminating the entire banknote sorter; furthermore, they contaminate the cutter blocks of the cutting device, thereby necessitating more maintenance of both the banknote sorter and the banknote destroying apparatus.

It has also been ascertained that the known apparatus with two cutting mechanisms involving a considerable noise level. Since the banknotes are not conveyed continuously but at irregular intervals, the development of noise is not constant but greatly varies, which is felt to be particularly unpleasant.

The problem on which the invention is based is therefore to propose a banknote destroying apparatus which has a high throughput when the banknotes are conveyed in quickly, has a simple construction and requires only little maintenance effort.

This problem is solved according to the invention by the features stated in the characterising part of the main claim.

The basic ides of the invention is to incorporate a cutting means which slits and crosscuts the material in one step, into a banknote sorter and to use it to destroy the rejected banknotes no longer fit for circulation.

This kind of slitting and crosscutting apparatus is known per se, but it exhibits considerable disadvantages which are prejudicial to continuous operation in a high-speed sorter. The major disadvantage of the known cutting apparatus is that there is constantly contact between the rotating cutter blocks and other elements. This may involve contact between the two cutter blocks which work into one another with little play, or friction of the cutter blocks, which are composed of single disks with spacers or stripping plates between the disks.

This kind of cutting apparatus which works with contact is quite suitable as a paper shredder for small quantities in an office, but it cannot be used economically for high speeds, continuous operation and high throughput capacity, since, on the one hand, the friction of the cutter blocks converts a large portion of the expended energy into heat, and, on the other hand, the wear of the cutter blocks is so high that constant maintenance of this functional unit would be necessary.

It has been shown in practice, surprisingly enough, that the known principle functions in the same way when the cutting elements of the cutter blocks are not arranged in contact with each other but spaced a small distance apart. The clamping effect on the banknotes achieved by the cutter blocks, which is necessary for their cutting function, is obtained to virtually the same extent in the case of non-contact cutting elements when the distance between cooperating cutting elements is smaller than the thickness of the banknotes to be destroyed.

It has also turned out, surprisingly enough, that the banknotes, at high speeds of the cutter blocks, are not only crosscut by one edge of the notches, as is usually the case at low speeds, but that suddenly the second edge also causes a cross-tear. However, a precondition for the function of the double cross-tear, in addition to the high speed, is that both edges of a notch have a sharp design.

The use of a cutting means modified in this manner in a high-speed banknote sorter involves a great number of particular advantages.

As opposed to the cutting means previously used in banknote sorters, only one cutting mechanism with two cutter blocks is now required to cut up the banknotes both longitudinally and transversely. The mechanical resources are therefore considerably reduced.

Due to the double cross-tear which surprisingly occurs at high speeds, the size of the banknote shreds is further reduced without any additional measures being required. The notches in the cutter blocks may thus have a substantially larger design for a given shred size than could be assumed according to prior art. Since larger notches are subject to less contamination and clogging, this results in a further advantage for use in equipment with a large throughput capacity.

Since the cutting mechanism now works in non-contact operation with regard to the cutter blocks, the development of heat in the cutting apparatus is considerably reduced. This is what makes continuous operation at high speeds at all possible. This advantage is of particular importance for continuous operation with a high throughput capacity, since it considerably increases the service life of the cutting means and greatly reduces the wear of the cutter blocks, so that the maintenance effort may be reduced to a reasonable degree. Furthermore, the mechanical efficiency of the cutting means, is greatly increased, since only a fraction of the required power is converted unnecessarily into heat and friction. Consequently, the entire cutting means can finally have smaller dimensions while retaining its efficiency.

The non-contact mode of operation also allows for the two cutter blocks to engage deeply with one another, thereby assuring particularly reliable slitting.

Since the banknotes are now singly cut up successively, without any back-up, in one continuous step, the quantity of banknotes to be processed, which essentially depends only on the speed of the piece number conveyed in, and the power required to destroy them are precisely predictable. The danger of back-ups is thus avoided to a large extent, and the cutting means can be precisely dimensioned, from a mechanical and an electrical point of view, in accordance with the requirements.

In spite of the simple construction as compared with known banknote cutting apparatus, the obtainable effect, i.e. slitting and crosscutting banknotes into small shreds, is the same. The advantage of random, arbitrary cutting of the banknotes as found in the prior art cited at the outset no longer exists, but this is compensated in the proposed solution by the fact that absolutely reliable shredding of the banknotes is guaranteed and that shred size can be set virtually at will by the number of notches in the cutting disks and the dimensioning of the width of the single cutter disks. Furthermore, the banknotes are more torn than cut by the non-contact cutter disks, so that the paper structure of the banknotes is permanently destroyed and reassemblage with intent to defraud must also be ruled out.

In accordance with a development, an air suction means is connected to the collecting vessel for the banknote shreds. This means is used to suck air through the cutting means into the collecting vessel, thereby cleaning and simultaneously cooling the cutting mechanism.

In an advantageous development of the invention, additional air conducting means are provided which allow for selective conductive of air.

The air which flows in the same direction as the banknotes supports the transportation of the banknote shreds, so that there is no more danger of a bank-up in the cutting apparatus. Any banknote shreds sticking to the cutter blocks are carried along by the air flow, so that the cutting mechanism is continuously cleaned during operation.

A further advantage is that the components surrounding the cutting apparatus are kept clean. Small banknote shreds which come about at the intake of the cutting apparatus due to the cutting or tearing process are directed towards the collecting vessel by the air flow. In an advantageous development, the stripping and cleaning of the cutter blocks and surroundings may be optimized by appropriately shaped air conducting plates. Since the area directly in front of the cutter blocks is continuously cleaned by the air flow, optical elements, for example a light barrier which registers the proper entry of a banknote to be destroyed, may also be arranged in this area.

Due to the air suction through the cutting means, the frictional heat which arises during the cutting or tearing process is also effectively dissipated. The bearings of the cutter blocks may also be cooled by a selective air flow.

The air flow additionally causes the banknote shreds to be whirled amongst themselves, so that it is impossible to assemble a banknote out of single parts.

The banknote shreds are finally collected in replaceable sacks. Due to the small shredding and the air-supported suction, the shreds are well compressed, thereby guaranteeing that the space in the refuse sacks is exploited well.

Further advantages and developments of the invention shall be described by way of example with reference to the adjoined drawings.

These show:

FIG. 1 a schematic view of a sorter consisting of single units

Figure 2:
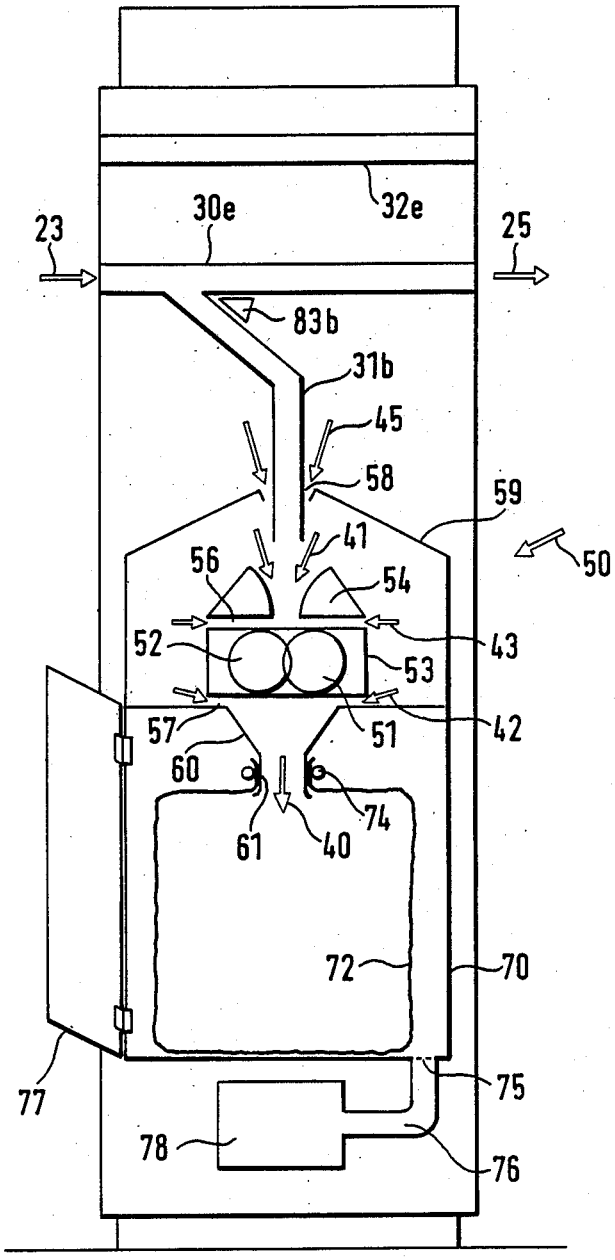

FIG. 2 a unit for destroying banknotes which are authentic but no longer fit for circulation (shredder)

Figures 3, 4:
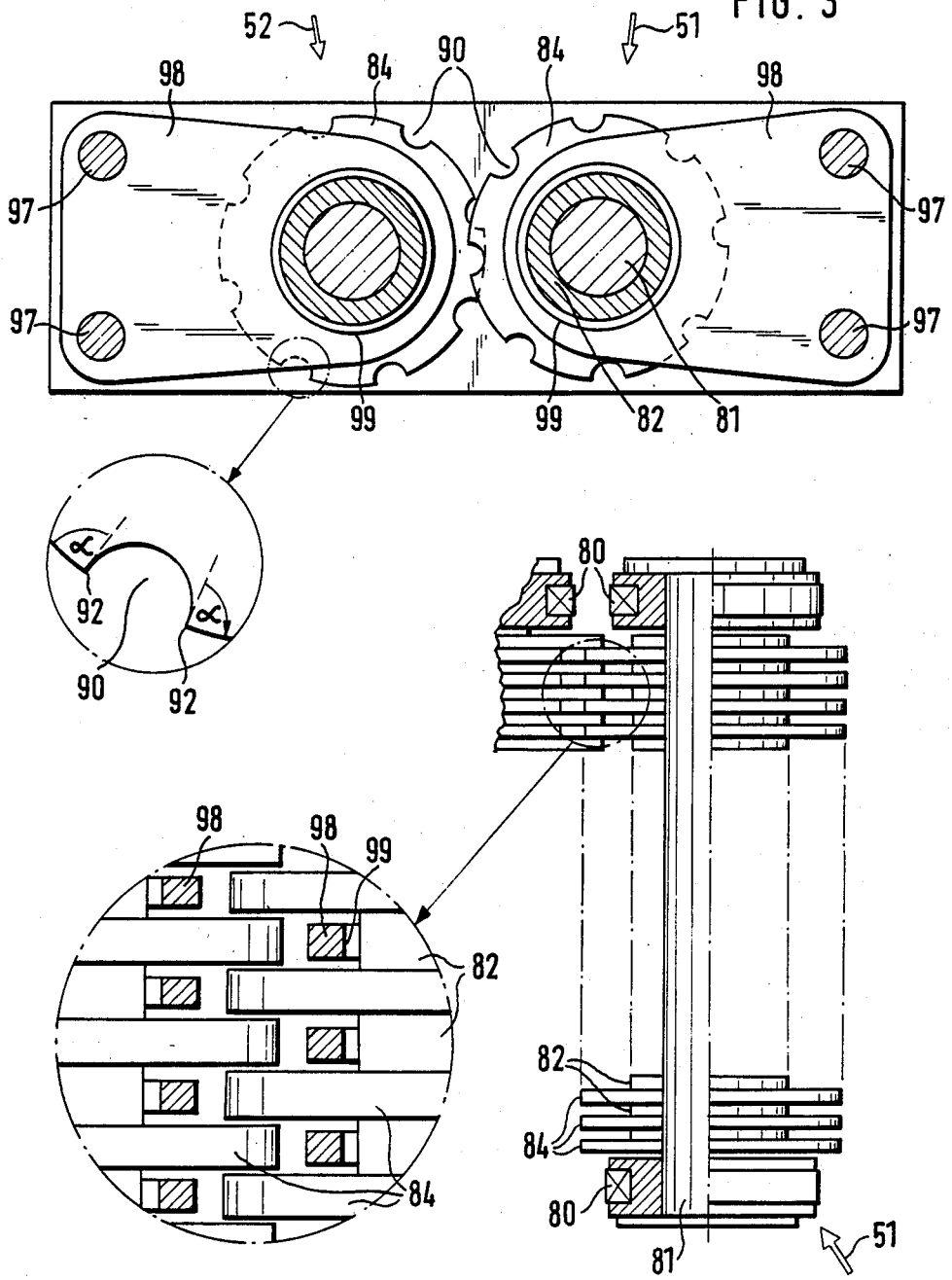

FIG. 3 an enlarged view of the cutting means

FIG. 4 a cutter block in a longitudinal section

The apparatus for sorting banknotes is precisely described in German Pat. No. 27 59 678. The sorter 1 sketched in FIG. 1 has a modular construction and consists of the following structural components:

- a unit 10 for singling and debanding the banknote packets,
- a unit 11 for singling and preliminarily testing the banknotes
- a unit 12 for testing the authenticity and state of the banknotes
- a unit 13 for destroying the banknotes not fit for circulation (shredder)
- two units 14, 15 for processing the banknotes not fit for circulation
- two units 16, 17 for processing the banknotes fit for circulation
- a unit 18 for depositing banknotes to be processed separately Following debanding and singling in units 10 and 11, the banknotes are conveyed via a conveyor system 30 to the various units and then via branches 31 to the corresponding deposit units. A separate conveyor system 32 is available for the bands.

The unit 13 shown in FIG. 2 for destroying banknotes not fit for circulation includes not only band conveyor section **32*e* and banknote conveyor sections 30*e* and 31*b*, but also essentially a diverter 83*b* for removing the banknotes not fit for circulation, and cutting means i.e., a shredder 50 and collecting vessel 70** for the banknote shreds. Further elements which are not necessary for understanding the invention, such as light barriers to monitor conveyance, conveying rollers, etc., have deliberately not been shown.

The cutting means consists of two cutter blocks 51, 52 which work into one another and are pivoted in a housing 53. The cutter blocks are set rotating by a drive assembly not shown in the Figure. A guide element 54 is disposed between conveyor system **31*b* and the entering side of cutting means 50. A funnel 60 is connected to the delivery side of the cutting means, and opens out into a pipe socket 61. Guide element 54 and funnel 60 are each separated from the housing wall of the cutting means by a narrow slot 56, 57**.

The entire cutting means is disposed in a housing 59 which preferably forms one unit with the collecting vessel housing. Conveyor system **31*b* conveys the banknotes to the cutting means through a narrow slot 58 in housing 59**.

Funnel 60 and pipe socket 61 open out into collecting vessel housing 70. In the example shown, a sack 72 serves as a collecting vessel, and is connected to pipe socket 61 by means of a rubber ring 74, or a similar means. In order to prevent the sack from slipping off the pipe socket, the latter may exhibit a notch or widened portion at its lower end.

Collecting vessel housing 70 forms a closed unit with an entering and a delivery opening 75. The entering opening is provided by the above-described funnel 60 and pipe socket 671. The delivery opening 75 is connected via a short pipe 76 to a suction plant 78, for example a vacuum pump. One side wall of housing 70 is designed as a door 77 which may be closed so as to be air-tight, so that sack 72 can be replaced when necessary.

Sack 72 is made, as in a vacuum cleaner, of a material which is penetratable by air but retains the cut up banknote shreds. Paper as is used, for example, for conventional vacuum cleaner bags, has proved to be a suitable material. This design offers the advantage that the collecting sack may be definitively destroyed together with the banknote shreds, for example by burning.

In operation, the banknotes are supplied, following the testing of their state and authenticity in unit 12, in the direction of arrow 23 to banknote destroying unit 13. The banknotes which are not to be destroyed run through this unit in the direction of arrow 25. Banknotes which are authentic but are no longer fit for circulation and are to be destroyed, are removed from conveyor system 30 by means of diverter **83*b* and supplied via conveyor system 31*b* to cutting means 50**.

After the banknotes have left the conveyor system, guide element 54 ensures that they are reliably fed between cutter blocks 51, 52, in spite of the high speed (10 m/s) at which the banknotes arrive. The banknotes are grasped by the cutter blocks provided with notches, are slit and crosscut or torn, and leave the cutting means in the form of small shreds.

Due to the continuous operation of the cutting means, i.e. the lack of deliberate back-up formation, disturbances are ruled out which might lead to the cutting means being clogged.

Suction plant 78 produces low pressure in the interior of collecting vessel 70, thereby sucking ambient air through funnel 60 in the direction of arrow 40. The low pressure is preferably set in such a way that the rate of flow of the air is greater than the speed of the arriving banknotes. A suitable design of the guide element ensures that most of the air taken in follows the same path as the arriving banknotes, i.e. hits the cutter blocks through the guide element and is directed via the funnel into collecting vessel 70. This air flow 41 shown in FIG. 2 guarantees both that any banknote shreds still sticking to the cutter blocks are removed and that the shreds are quickly conveyed away, thereby additionally avoiding any clogging of the cutting means. Further, the cutter blocks and surrounding structural components, in particular the bearings of the cutter blocks, are cooled by the air current. An appropriate design of the guide element and/or additional air-conducting plates may be used to optimize the cooling of particular components and remove the shreds from the cutter blocks in accordance with specific conditions. For example, the flow channel may be selectively constricted to increase the velocity of flow, thereby further improving the stripping effect.

Due to the low pressure in collecting vessel 70, ambient air is also taken in along paths 42, 43 through slots 56, 57 between housing 53 and guide element 54 or funnel 60, and is directed through funnel 60. Thus, the entire cutting means is exposed to a flow of air through and around it from several sides at the same time. Furthermore, this open construction allows for free access to the various components and their mounting and dismounting.

Due to the various air flows through the cutter blocks and around the cutting means, which are all directed towards the funnel and the collecting vessel, the entire banknote cutting means 50 is continuously cleaned during operation.

The air sucked off by vacuum pump 78 may enter housing 59 only through slot 59 due to the closed housing 59 surrounding the entire cutting means. This produces a continuous air flow 45 which prevents dust or small banknote shreds, which might contaminate the entire banknote sorter, from exiting through intake gap 58.

The banknote shreds are whirled amongst themselves by air flow 40 in funnel 60, and finally land in collecting sack 72 in collecting vessel 70. Due to the small shredding and supported by the air suction, the cut up banknotes are compressed and allow for the space in the collecting sack to be well exploited. If necessary, the collecting sack may be replaced, when it is full, after opening door 77.

FIG. 3 shows the cutting means with the two cutter blocks 51, 52 which work into one another. One cutter block in a longitudinal section is shown in FIG. 4.

The cutter blocks, which each run in two bearings 80, may be made of round stock into which annular grooves are milled to form the cylindrical cutting elements.

In another, preferred embodiment, the cutter blocks consist of a plurality of cutting disks 84 separated by spacing disks 82, the disks arranged on an axle shaft 81. This design offers the advantage that single cutting disks 84 may be replaced, if necessary, without any need to replace the entire cutter block. The width of cutting disks 84 is slightly smaller than that of the spacing disks, so that the cutting disks of the second block 52 do not come in contact with the cutting disks of the first block 51 when the blocks mesh. For example, spacing disks 82, or the milled recesses, may be 1.45 mm wide, and cutting disks 84, or the non-milled portions of the block, may be 1.4 mm wide. This results in a distance of 0.025 mm between two cooperating cutting disks, which is considerably smaller than the usual thickness of banknotes, i.e. 0.1 mm. These dimensions assure that the banknotes are reliably clamped between the cutting disks as is necessary for perfect shredding.

Cutting disks 84 and spacing disks 82 are firmly connected to each other in the axial direction, so that the distance set by the spacing disks is firmly prescribed and cannot be altered in operation. The cutter block thus constitutes a rigid unit when constructed of single cutting disks and spacing disks.

As can also be seen in FIG. 3, stripping plates 98 are provided which are each arranged in the gaps between the cutting disks. Stripping plates 98 are held in a predetermined position by two mandrels 97 attached to housing 53. In the area of axle shaft 81 plates 98 have a circular recess 99 the opening of which is larger than the diameter of spacing disks 82, so that the rotation of the cutter block is not impeded by stripping plates 98. The thickness of stripping plates 93 is set so small, in comparison with the thickness of spacing disks 82, that friction can be ruled out. For example, the plates may be 1 mm thick when the spacing disks are 1.45 mm thick, as stated above. Plates 98 remove any banknote shreds still sticking to cutter blocks 51, 52 after the cutting process, thereby preventing the shreds from again taking part in the cutting process after one complete rotation of the cutter block and possibly having an adverse effect thereon or leading to clogging. In the cutting area of the cutter blocks stripping plates 98 are dimensioned in such a way that there is no contact with whichever cutter block is located opposite.

Cutting disks 51, 52 are provided along their periphery with a plurality of notches 90. Notches 90 may have any design desired; the only essential point is that edges 92 must be sharp and cut or tear the banknotes transversely in combination with the disks of the second cutter block. It has been shown in practice that an angle $\alpha$ of the cutting edges of approximately 90° provides very good results. In a preferred embodiment notches 90 have a symmetrical design. An example of symmetrical notches 90 is shown in FIG. 3, wherein the notches have a semicircular design and their depth corresponds approximately to the radius of the circle.

It is necessary for reliable functioning that edges 92 of notches 90 which cause the crosscutting cooperate with areas on the cutting disks arranged on the other cutter block, which do not exhibit any notches. This is obtained by rotating one cutter block relative to the other around an angle which is half as large as the angle between two successive notches 90. In order to maintain this position relative to one another, the two cutter blocks are rigidly joined together, for example by means of toothed wheel work or toothed belts.

Experiments have shown that several parameters must be observed in case both edges of the notches are to effect cross-tearing. As already mentioned, a essential precondition is the high speed of the cutter blocks. Further, the sharpness of the cutting edges 92 as well as the width of the cutting disks and the rigidity of the banknotes to be cut are significant. It has been shown that the second edge of each notch "cuts" more poorly, even at high speeds, than the edge which is already effective at low speeds. Since the force to be exerted for cross-tearing depends on the width of the single strips, the width of the cutter and strip must also be made dependent upon the speed of the cutter blocks and/or the conveying speed of the banknotes. Strip widths of 1.45 mm have proved useful in practice for badly worn banknotes at a conveying speed of 10 m/s. The speed of the cutter blocks was approximately 3000 revolutions per minute.

The cutting means described allows, in the embodiment shown in the Figures, for a banknote to be cut into approx. 500 single shreds about 1.5 mm wide and 12 mm long (the cutting disks having a diameter of 63 mm).

The proposed cutting means also works perfectly when the banknotes are conveyed at high speeds. In practice, about 40 banknotes a second are cut into small shreds without disturbance at a speed of 100 m/s. The heating of the cutter blocks is relatively low even in the case of continuous operation of the cutting means and uninterrupted destruction of banknotes. Experiments with continuous operation have shown that temperatures of 55° C. are hardly exceeded.

Cutting means 50 with cutter blocks 51, 52 and the entire banknote destroying unit 13 also remain free of continuation and dust for a long period of time, due to the air suction.

We claim:

1. An apparatus for high speed shredding documents such as banknotes in a high-speed sorter, in which sorter the documents are removed from a stack one by one, tested according to various criteria and assigned to certain sorting classes as a result of the testing, one sorting class embracing documents which are supplied by a conveyor system to a shredder means and destroyed therein, comprising a shredder means including overlapped cutter disks mounted in fixed, spaced apart relationship on parallel rotatable shafts so that the disks are spaced apart from each other, each cutter disk including peripheral crosscutting notches that are out of registration with notches of adjacent disks;

a collecting means for the document shreds disposed downstream of the shredder in the direction of movement of the documents; and a vacuum pump arranged to produce low pressure in the collecting means;

said collecting means including an entry opening, through which opening air is sucked through the shredder means due to the low pressure in the collecting means; and wherein said shredder means includes air conducting means forming flow channels through and around said cutter disks, said flow channels increasing the velocity of air sucked through the channels such that banknote shreds sticking to the cutter disks are stripped off and that the cutter disks are exposed to a flow of cooling air through and around the cutter disks.

2. An apparatus for high speed shredding documents such as banknotes in a high-speed sorter, in which sorter the documents are removed from a stack one by one, tested according to various criteria and assigned to certain sorting classes as a result of the testing, one sorting class embracing documents which are supplied by a conveyor system to a shredder means and destroyed therein, comprising a shredder means including overlapped cutter disks mounted in fixed, spaced apart relationship on parallel rotatable shafts so that the disks are spaced apart from each other, each cutter disk including peripheral crosscutting notches that are out of registration with notches of adjacent disks;

a collecting means for the document shreds disposed downstream of the shredder means in the direction of movement of the documents; and a vacuum pump arranged to produce low pressure in the collecting means;

said collecting means including an entry opening, through which opening air is sucked through the shredder means due to the low pressure in the collecting means;

said entry opening being configured and oriented relative to said shredder means in such a way that most of said air follows the same path as the banknotes approaching the shredder means from the conveyor system; and wherein said shredder means includes air conduction means forming flow channels through and around said cutter disks, said flow channels increasing the velocity of air sucked through the channels such that banknote shreds sticking to the cutter disks are stripped off and that the cutter disks are exposed to a flow of cooling air through and around thecutter disks.

3. The apparatus as claimed in claim 2 including air gaps at least between said entry opening and said shredder means, whereby due to the low pressure, ambient air is also sucked through said air gaps.

4. An apparatus for high speed shredding documents such as banknotes in a high-speed sorter, in which sorter the documents are removed from a stack one by one, tested according to various criteria and assigned to certain sorting classes as a result of the testing, one sorting class embracing documents which are supplied by a conveyor system to a shredder means and destroyed therein, comprising a shredder means including overlapped cutter disks mounted in fixed, spaced apart relationship on parallel rotatable shafts so that the disks are spaced apart from each other, each cutter disk including peripheral crosscutting notches that are out of registration with notches of adjacent disks;

a collecting means for the document shreds disposed downstream of the shredder means in the direction of movement of the documents; and a vacuum pump arranged to produce low pressure in the collecting means;

said collecting means including an entry opening, through which opening air is sucked through the shredder means due to the low pressure in the collecting means;

said low pressure being such, that the velocity of flow of the air is greater in the area of the shredder means that the speed of the documents approaching the shredder means from the conveyor system; and wherein said shredder means includes air conducting means forming flow channels through and around said cutter disks, said flow channels increasing the velocity of air sucked through the channels such that banknote shreds sticking to the cutter disks are exposed to a flow of cooling air through and around the cutter disks.

* * * * *